US008622006B2

(12) United States Patent
Dubois

(10) Patent No.: US 8,622,006 B2
(45) Date of Patent: Jan. 7, 2014

(54) PALLET

(75) Inventor: Jean-Marc Dubois, Bremgarten (CH)

(73) Assignee: Georg Utz Holding AG, Bremgarten (CH)

( * ) Notice: Subject to any disclaimer, the term of this patent is extended or adjusted under 35 U.S.C. 154(b) by 458 days.

(21) Appl. No.: 12/321,979

(22) Filed: Jan. 28, 2009

(65) Prior Publication Data

US 2009/0188412 A1 Jul. 30, 2009

(30) Foreign Application Priority Data

Jan. 29, 2008 (DE) ..... 10 2008 006 388

(51) Int. Cl.
*B65D 19/38* (2006.01)

(52) U.S. Cl.
USPC ..... 108/57.25; 108/57.31; 108/901; 108/56.1

(58) Field of Classification Search
USPC ..... 108/57.25, 901, 51.11, 57.18, 57.27, 108/57.28, 57.29, 57.31, 57.34, 56.1, 56.3, 108/57.26
See application file for complete search history.

(56) References Cited

U.S. PATENT DOCUMENTS

| | | | | |
|---|---|---|---|---|
| 3,424,110 | A * | 1/1969 | Toot | 108/53.3 |
| 3,467,032 | A | 9/1969 | Rowlands et al. | |
| 3,699,901 | A * | 10/1972 | Cook, III | 108/57.25 |
| 3,789,519 | A * | 2/1974 | Montgomery et al. | 434/302 |
| 4,029,023 | A * | 6/1977 | Rosewicz et al. | 108/57.28 |
| 4,735,154 | A * | 4/1988 | Hemery | 108/56.1 |
| 5,413,052 | A * | 5/1995 | Breezer et al. | 108/56.1 |
| 5,868,080 | A * | 2/1999 | Wyler et al. | 108/57.25 |
| 6,029,583 | A * | 2/2000 | LeTrudet | 108/57.25 |
| 6,199,488 | B1 * | 3/2001 | Favaron et al. | 108/57.25 |
| 6,234,087 | B1 | 5/2001 | Brown | |
| 6,446,563 | B1 * | 9/2002 | Ohanesian | 108/57.25 |
| 6,807,910 | B2 * | 10/2004 | Apps | 108/57.25 |
| D590,573 | S * | 4/2009 | Hermans | D34/38 |
| 7,748,330 | B2 * | 7/2010 | Dubois et al. | 108/56.3 |
| 8,042,250 | B2 * | 10/2011 | Dubois | 29/450 |
| 2004/0112262 | A1 | 6/2004 | Moore, Jr. et al. | |
| 2004/0222222 | A1 | 11/2004 | Parnall et al. | |
| 2006/0201402 | A1 | 9/2006 | Moore, Jr. et al. | |
| 2007/0131148 | A1 * | 6/2007 | Wu | 108/57.25 |
| 2007/0163473 | A1 * | 7/2007 | Shuert | 108/57.25 |
| 2008/0141912 | A1 * | 6/2008 | Valentinsson | 108/57.33 |

FOREIGN PATENT DOCUMENTS

| | | |
|---|---|---|
| DE | 10 2004 049 201 | 4/2006 |
| DE | 10 2007 013 210 | 9/2008 |

* cited by examiner

*Primary Examiner* — Darnell Jayne
*Assistant Examiner* — Andres F Gallego
(74) *Attorney, Agent, or Firm* — Collard & Roe, P.C.

(57) ABSTRACT

A pallet for storage and transport of goods consists of an upper deck that serves as a standing surface for the goods, standing feet that can be assembled onto the underside of the upper deck, and accommodation channels formed into the upper deck, for affixing at least one reinforcement strip. The upper deck is divided into at least two rectangular partial regions, and each partial region has an accommodation channel for a reinforcement strip, which is disposed in the diagonal of the partial region.

10 Claims, 11 Drawing Sheets

PALLET

CROSS REFERENCE TO RELATED APPLICATIONS

Applicant claims priority under 35 U.S.C. §119 of German Application No. 10 2008 006 388.6 filed Jan. 29, 2008.

BACKGROUND OF THE INVENTION

1. Field of the Invention

The invention relates to a pallet for storage and transport of goods, consisting of an upper deck that serves as a standing surface for the goods, standing feet that can be assembled onto the underside of the upper deck, and accommodation channels formed into the upper deck, for affixing at least one reinforcement strip.

2. The Prior Art

Such pallets are described, for example, in German Patent Applications Nos. DE 10 2004 049 201 A1 and DE 10 2007 013 210. In the case of these known pallets, a diagonally-running reinforcement strip, for example made of steel, is used to reinforce the upper deck.

This reinforcement strip gives the pallet fairly good stability under normal stress, particularly if only one item of transport goods that fills up the entire area of the upper deck is set onto the pallet.

However, since often a plurality of smaller containers are also set down next to one another on such pallets, the stability in the regions between the diagonal reinforcement strip is often insufficient.

SUMMARY OF THE INVENTION

It is therefore an object of the invention to guarantee stability over the full area of these pallets.

The invention achieves this object by a pallet in which the upper deck is divided into at least two rectangular partial regions, and each partial region has an accommodation channel for a reinforcement strip, which is disposed diagonally across the partial region.

In this way, significantly better stability is achieved than in the case of the known solution, by means of the reinforcement strips that are laid parallel to one another in the partial region areas.

Stability is further increased if another accommodation channel for a reinforcement strip is provided in the progression of the border between the partial regions. Accommodation channels for reinforcement strips can also be provided in the regions of the longitudinal side edges of the upper deck.

In this connection, the reinforcement strips each have the same length, both in the partial region diagonals and in the border region between the partial regions, as well as in the regions of the longitudinal side edges, where their ends are beveled at an acute angle, for example 45°.

Specifically because of this bevel, it is possible to produce not only the reinforcement strips that run diagonally but also the ones that run parallel to the longitudinal side edges in the same length, and this simplifies the production effort and the assembly of the pallets.

In a final expansion stage, accommodation channels for reinforcement strips are also provided in the regions of the short side edges of the upper deck.

Fixation of the reinforcement strips in the individual accommodation channels is possible in different ways. In one embodiment, the reinforcement strips are secured in the accommodation channels by the standing feet that are assembled on.

For this purpose, the standing feet are screwed onto the four corner points, and possibly also onto the center points of the short sides of the upper deck.

One standing foot can also be screwed on in the center of each of the longitudinal sides of the upper deck, for further stabilization of the pallet.

In another embodiment, accommodations are formed into the standing surfaces of the standing feet, in which the feet can be attached with runners connecting one another. At their ends, the runners have appropriate tab-like engagement elements that are introduced into the accommodations and screwed in place there. The runners increase the stability of the pallet and are provided with a bevel, so that problem-free introduction of the forks of a lift truck is guaranteed.

In a further embodiment, accommodations in the standing surfaces of the standing feet are disposed in a symmetrical pattern. This means that the standing surface of the standing feet, which is generally rectangular, has one accommodation in the region of each of the short sides of this rectangle, and two accommodations in each of the longitudinal sides of the rectangle.

In this way, it is possible to increase the number of standing feet that are disposed next to one another, or to connect another pallet to a pallet that has already been assembled. It is possible to have two standing feet disposed directly next to one another at the connection location of the two pallets, whereby the accommodations that lie opposite one another are connected with one another. In the case of this type of pallet expansion, the accommodation channels in the short sides of the upper deck are continuous towards the side, so that one reinforcement strip that covers both pallets can be inserted.

However, it is also possible to do without a standing foot disposed adjacent, by means of runners having the appropriate dimensions, and to produce a connection from the side standing foot of the one pallet to the center foot of the joined pallet.

The upper deck can be, for example, an injection-molded plastic part that has a reinforcing rib pattern. The upper side of the upper deck can be covered by a plastic panel that is welded on. The standing feet can also be injection-molded plastic parts.

The shape of the reinforcement strips can be varied. Preferably, the strips are tubes having a rectangular cross section and are made from metal.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 2 shows a pallet according to FIG. 1 with a plastic panel welded on;

FIG. 6 shows a pallet according to FIG. 1 in a fourth alternative;

DETAILED DESCRIPTION OF THE PREFERRED EMBODIMENT

Figure 1:
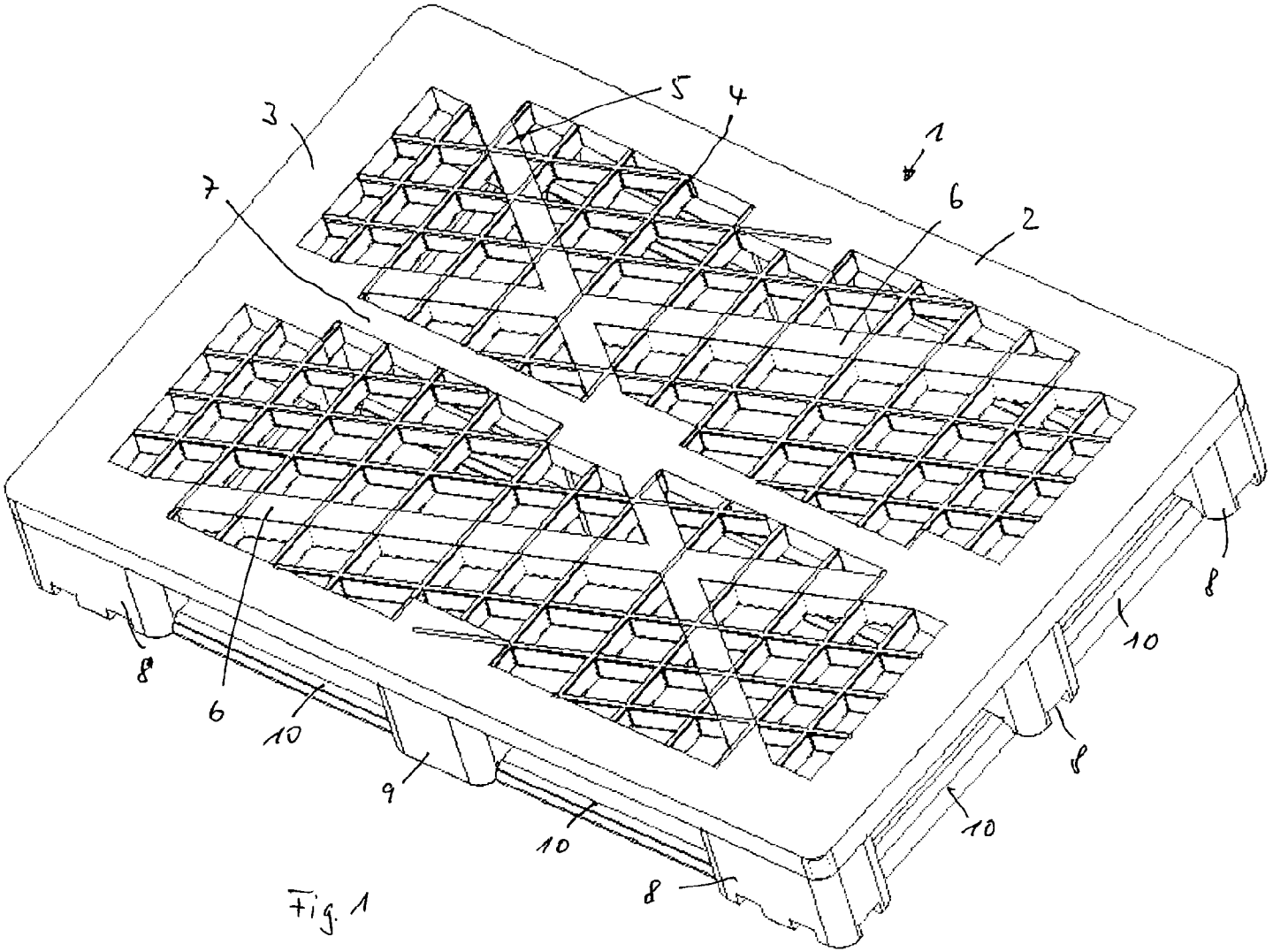
FIG. 1 shows a perspective view of an assembled pallet according to one embodiment of the invention.

In FIG. 1, a pallet is shown and indicated in general with the reference symbol 1. It consists of an upper deck 2, which has a rectangular frame 3 that encloses a rib structure 4. Frame 3 and rib structure 4 form the standing surface for goods set down onto the pallet 1.

Accommodation channels 5, 6, 7 are formed into upper deck 2, integrated into rib structure 4, and connecting frame parts 3 with one another. Channel 5 passes through upper deck 2 diagonally. Channels 5 and 6 pass through two partial areas of upper deck 2 diagonally. Deck 2 is divided into two rectangles disposed symmetrical to one another, by channel 7.

On the underside of upper deck 2, standing feet 8, 9 are screwed on and are connected with one another on their underside by means of runners 10.

Figure 2:
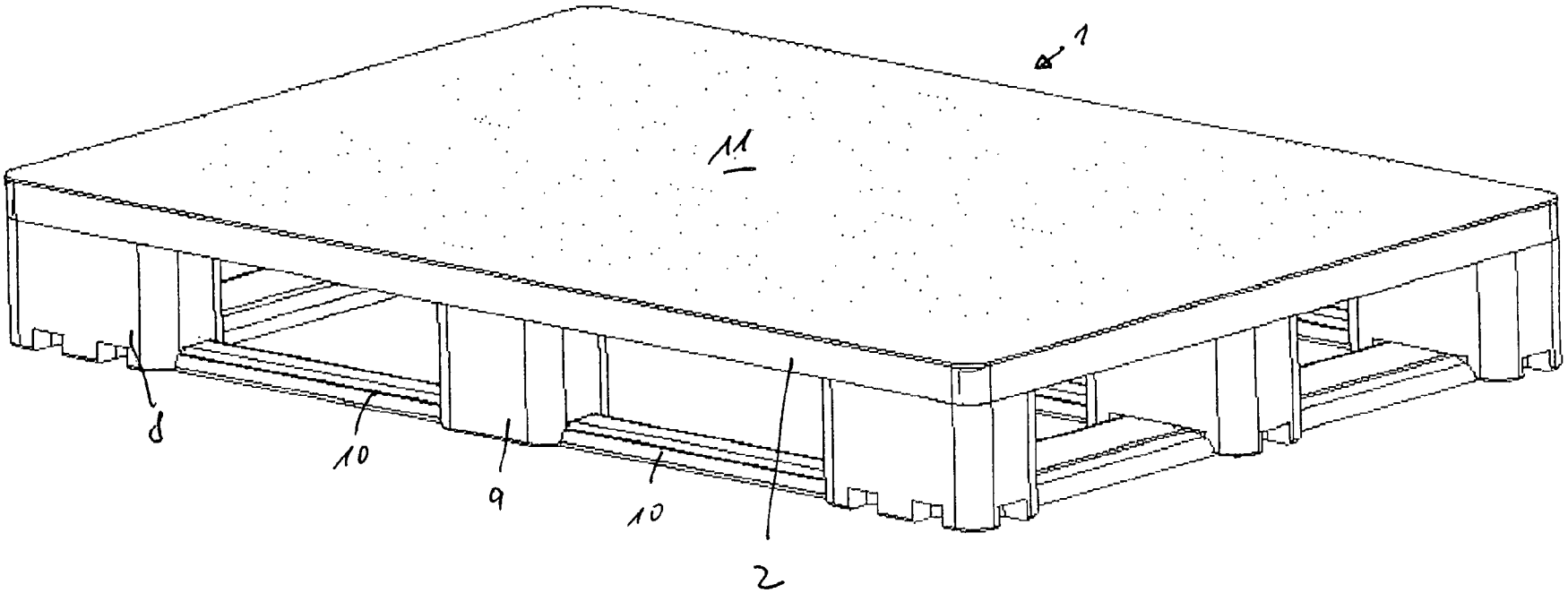

FIG. 2 shows a pallet 1 that corresponds to the pallet 1 in FIG. 1, but is provided with a welded-on plastic panel 11 on the surface of upper deck 2.

Figure 3:
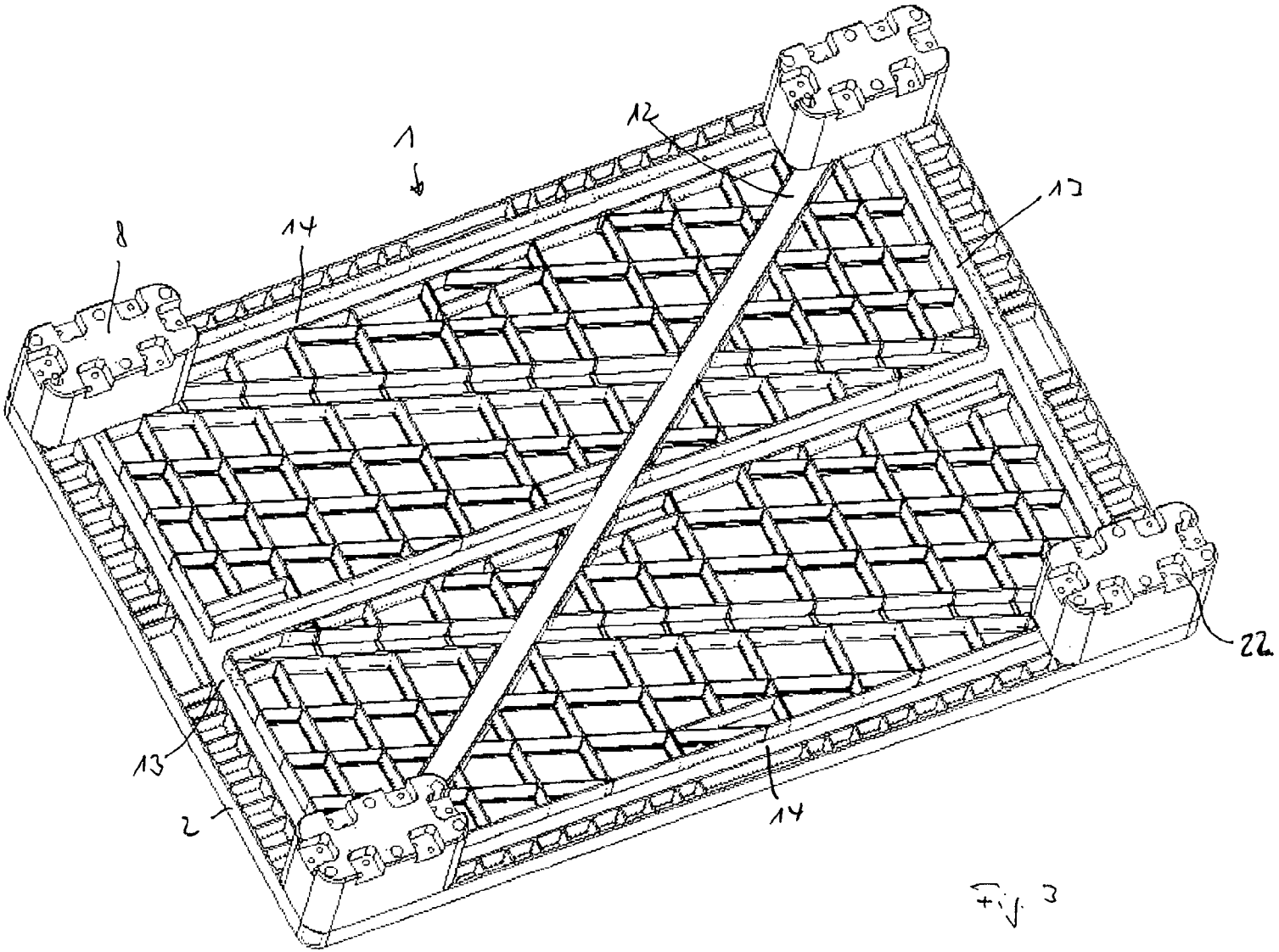
FIG. 3 shows a pallet according to FIG. 1 in a view from the bottom in a first alternative.

FIG. 3 shows a pallet 1, specifically in its simplest embodiment. Here, standing feet 8 are screwed on only at the corner points of upper deck 2, and a reinforcement strip 12 made of metal is laid into the diagonal accommodation channel 5; the strip is secured in its position by standing feet 8.

As is evident from FIG. 3, additional accommodation channels 13, 14 are formed into the longitudinal side region and into the short side region of upper deck 2.

Figure 4:
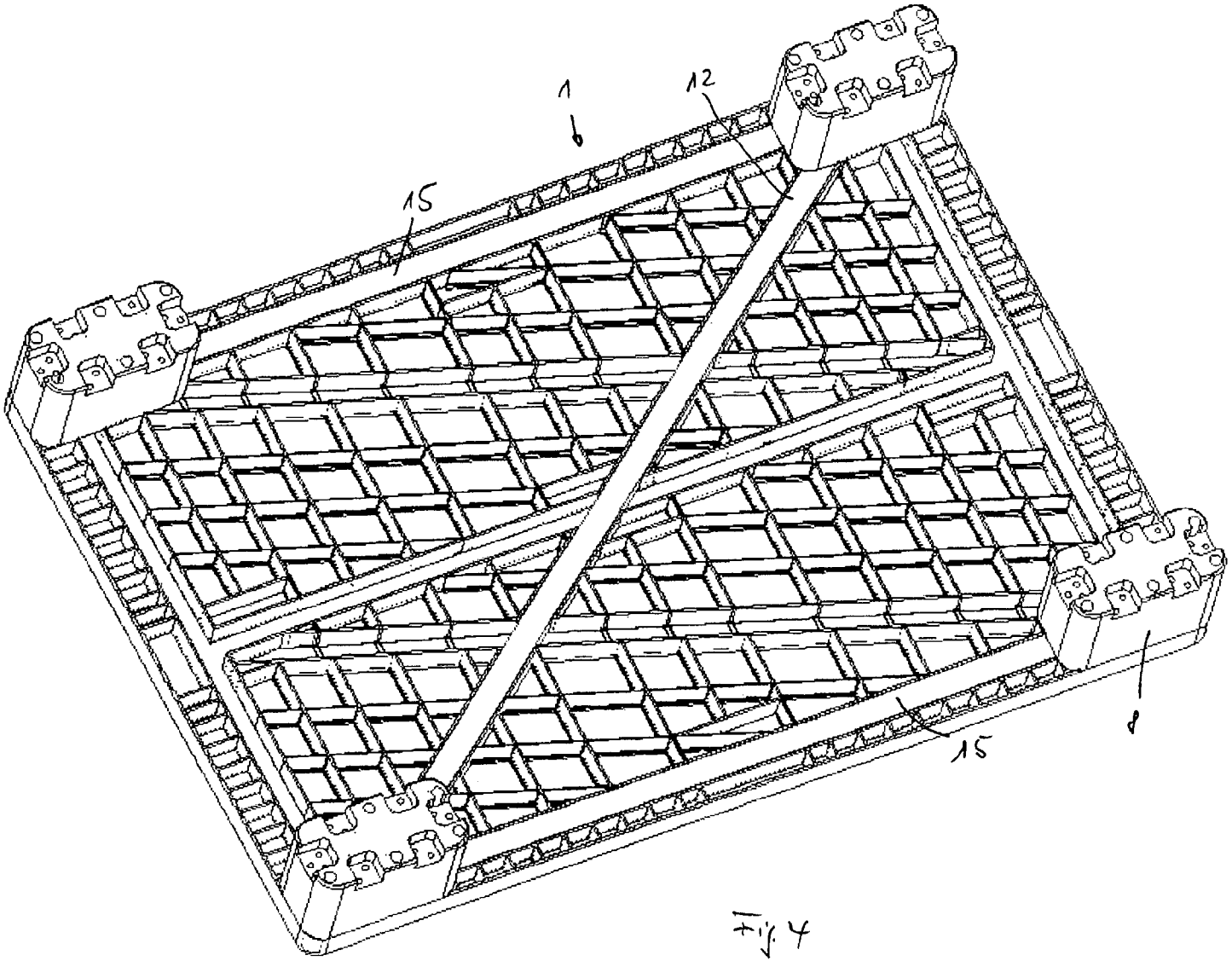
FIG. 4 shows a pallet according to FIG. 3 in a second alternative.

FIG. 4 shows a pallet 1 as shown in FIG. 3, but here, additional reinforcement strips 15 are laid into accommodation channels 14. These reinforcement strips 15 are also secured in their position by standing feet 8.

Figure 5:
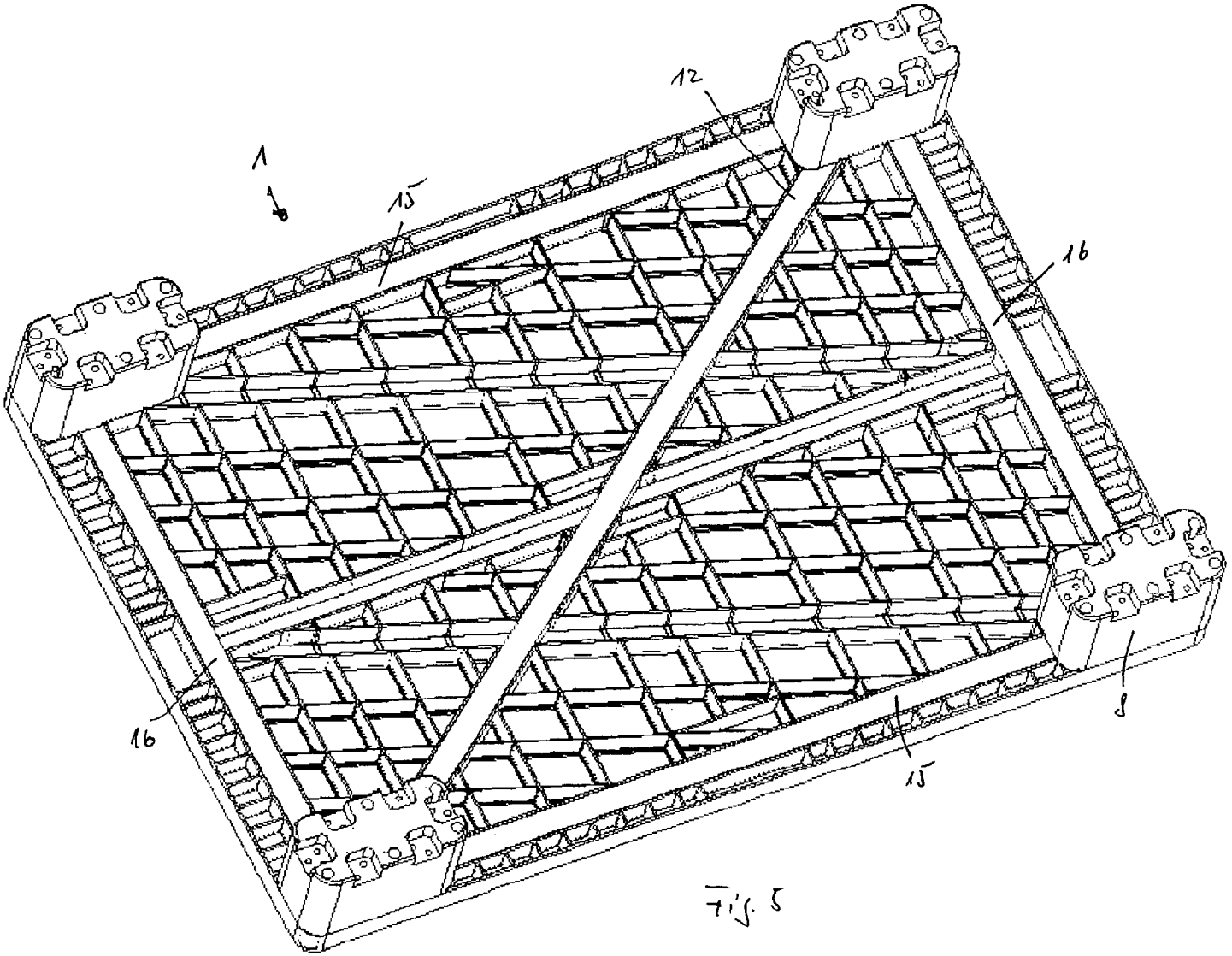
FIG. 5 shows a pallet according to FIG. 3 in a third alternative.
Figure 4:
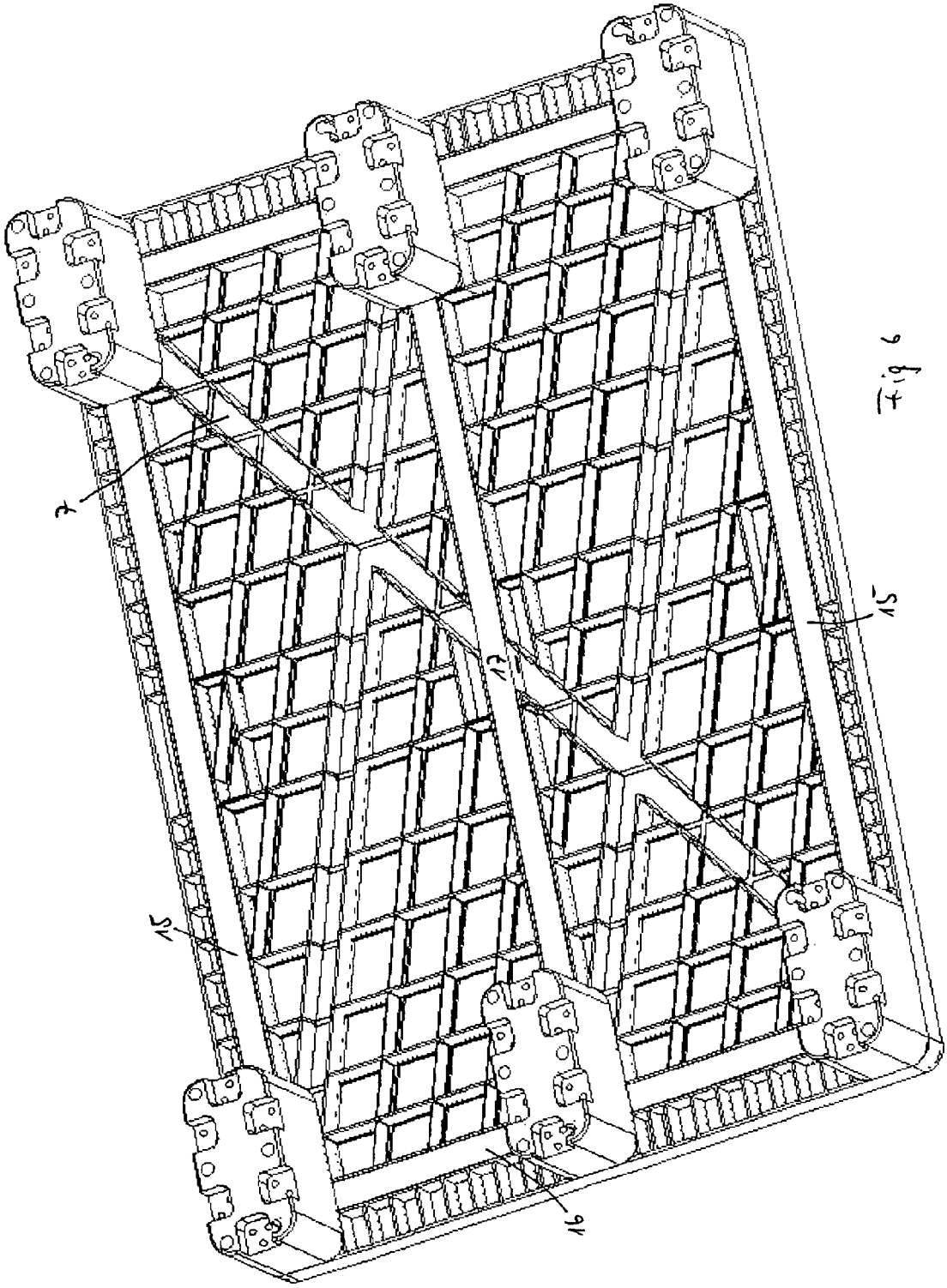

FIG. 5 shows another expansion stage of pallet 1. In addition to the reinforcement strips as they are laid into the pallet according to FIG. 4, additional reinforcement strips 16 are laid into accommodation channels 13. These reinforcement strips 16 are also held by screwed-on standing feet 8.

FIG. 6 shows an alternative embodiment of pallet 1. Here, there is no diagonal reinforcement by means of strip 12. Instead, a reinforcement strip is laid into accommodation channel 7 that runs parallel to accommodation channels 14. Two additional standing feet 8 are assembled onto the ends of accommodation channels 7; they secure reinforcement strip 17 in its position.

Figure 7:
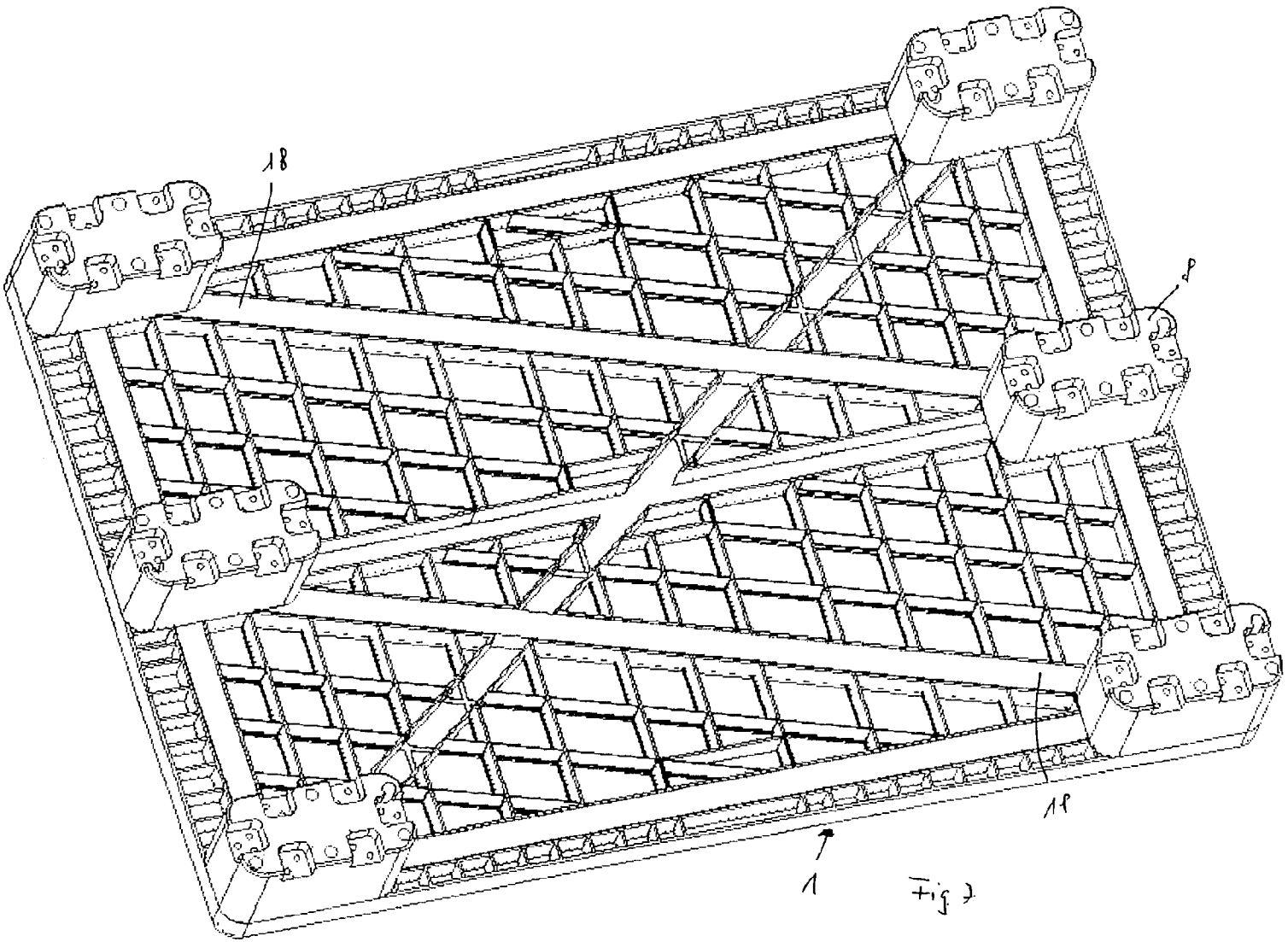
FIG. 7 shows a pallet according to FIG. 1 in a fifth alternative.

FIG. 7 shows a pallet according to FIG. 6, whereby here, reinforcement strip 17 has been left out. Instead, two reinforcement strips 18 that run parallel to one another have been laid into accommodation channels 5 and 6; they run in the diagonal of the partial regions of upper deck 2. These two reinforcement strips 18 are also held in their position by standing feet 8.

Figure 8:
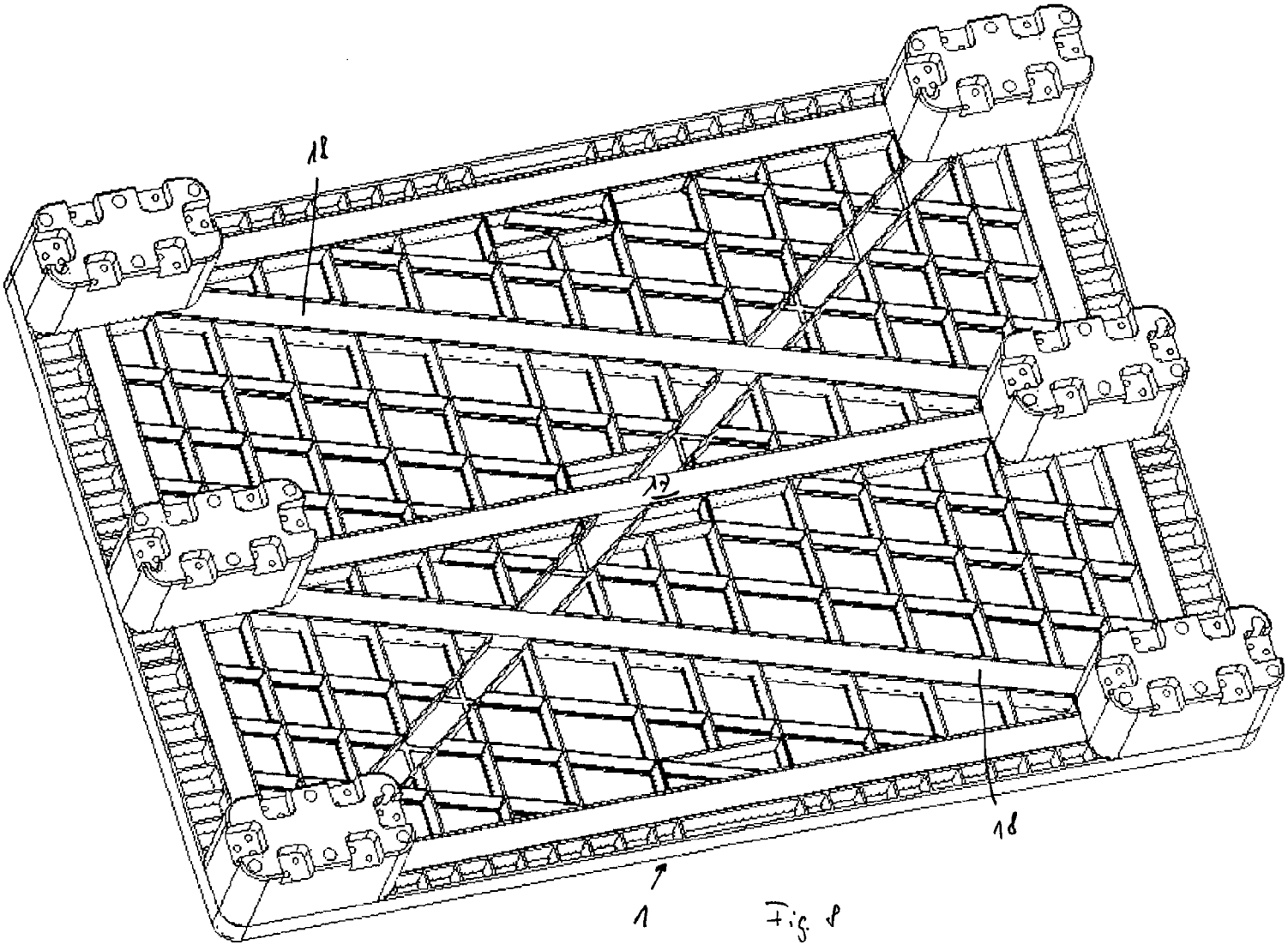
FIG. 8 shows a pallet according to FIG. 1 in a sixth alternative.

FIG. 8 shows a completely reinforced pallet 1, whereby in addition to the reinforcements in FIG. 7, reinforcement strip 17 is provided.

Figure 9:
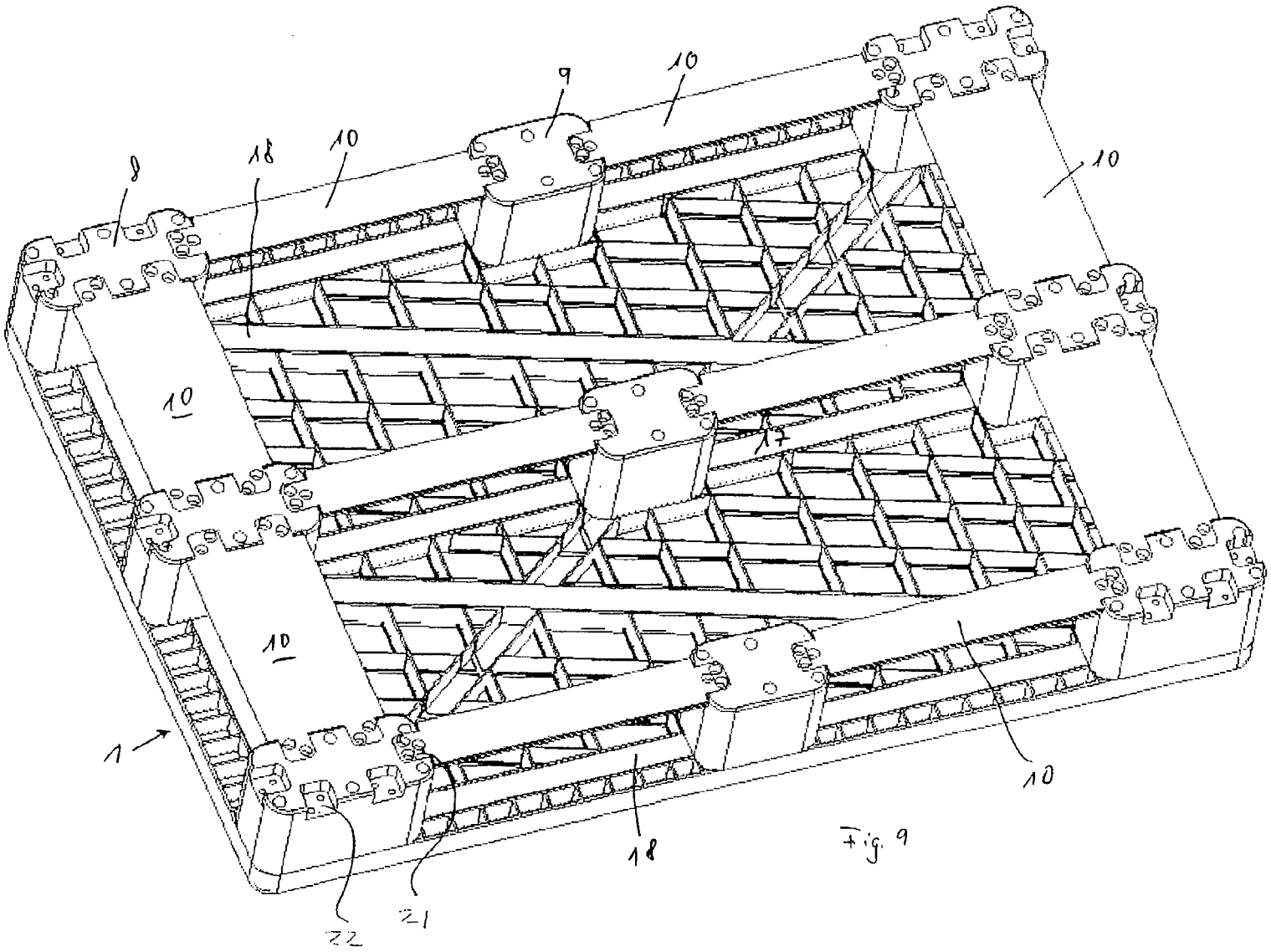
FIG. 9 shows a pallet according to FIG. 1 in a view from below (completely assembled)

In FIG. 9, the pallet according to FIG. 1 is shown from below, whereby here, standing feet 8 and 9 are connected with one another by means of runners 10. Runners 10 have tabs 21 at their ends, which tabs are laid into corresponding recesses 22 in the standing surfaces of standing feet 8 and 9, respectively, and screwed on there.

Standing feet 8 have a recess structure that is configured in such a manner that two recesses 22 are present symmetrical to the center longitudinal axis, while only one recess 22 is present symmetrical to the crosswise axis of the standing surface.

In the case of standing feet 9, only two recesses 22 are present, symmetrical to the crosswise axis of the standing surface.

Figure 10:
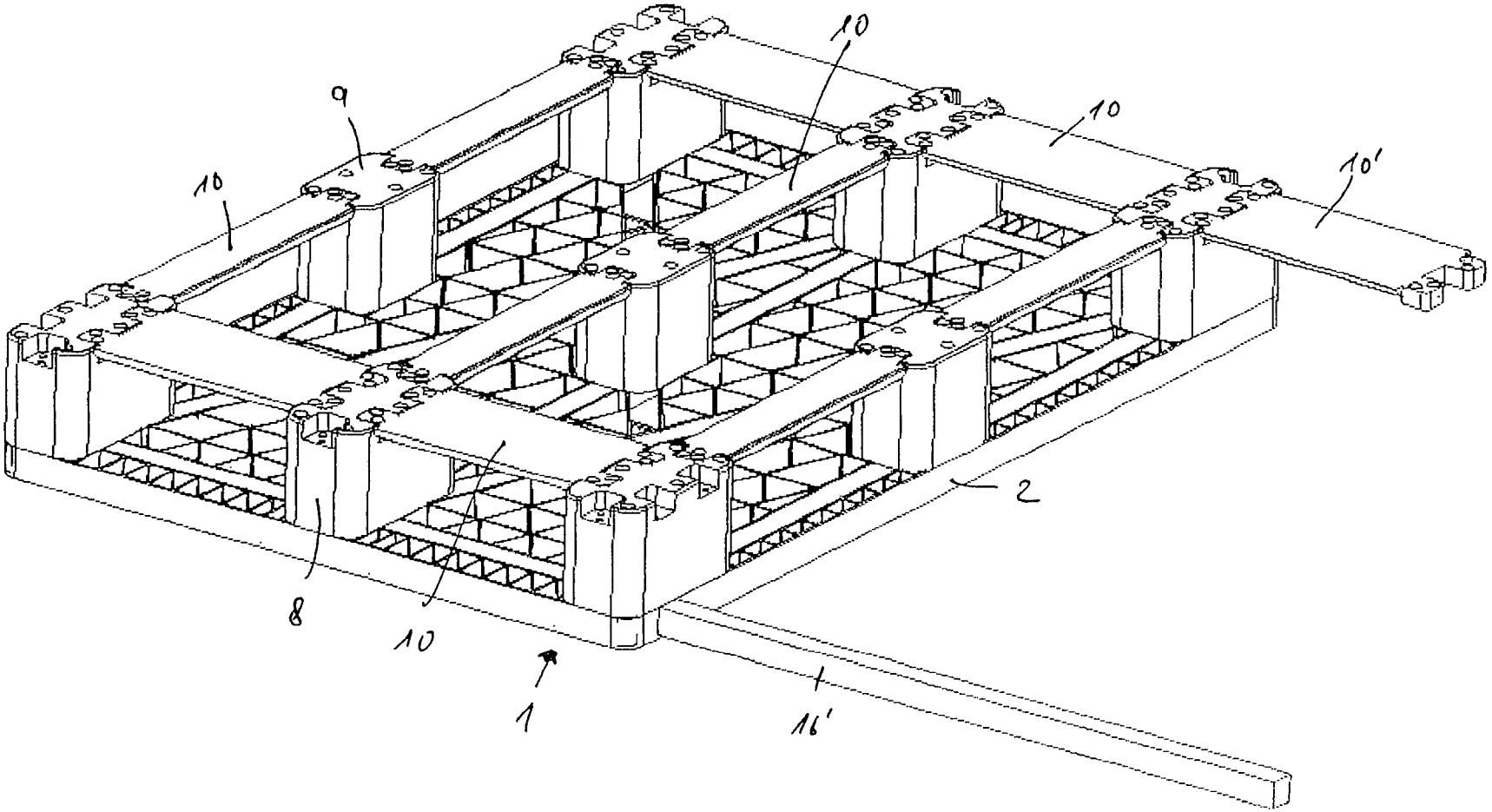
FIG. 10 shows a representation of the expandability of the pallet according to FIG. 1.

In FIG. 10, the possibility is indicated that two pallets can be connected with one another. For this purpose, accommodation channels 13 are open on the side, so that an extra-long reinforcement strip 16' can be laid in. The projecting end of reinforcement strip 16' is laid into accommodation channel 13 of another upper deck, not shown.

FIG. 10 shows that another runner 10', the length of which does not have to be equal to the length of runners 10 in pallet 1 that has already been completed, extends from standing foot 8, so that the two pallets 1 disposed next to one another are securely connected with one another.

Figure 11:
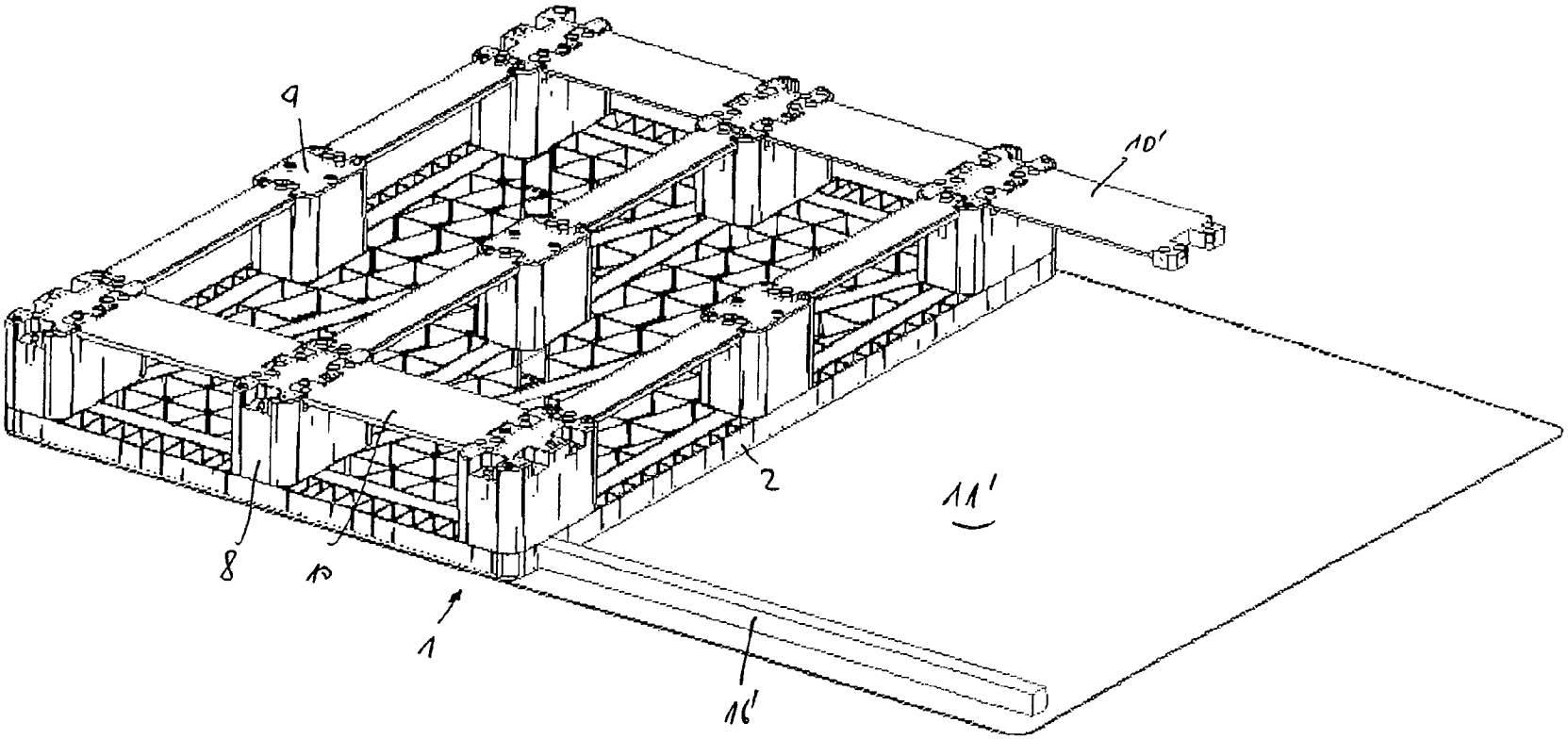
FIG. 11 shows expandability of the pallet according to FIG. 2.

Finally, FIG. 11 shows the expansion stage according to FIG. 10, whereby—as shown in FIG. 2—a plastic panel 11' to be welded on is provided.

Alternatively to the embodiments in FIGS. 10 and 11, it is possible that additional standing feet 8 can be disposed directly next to the outer standing feet 8 that are adjacent to the pallet expansion, which then can be connected with one another, i.e. from pallet to pallet expansion. In this embodiment, the runners 10 can have the same length as in the case of the original pallet 1.

Accordingly, while only a few embodiments of the present invention have been shown and described, it is obvious that many changes and modifications may be made thereunto without departing from the spirit and scope of the invention.

What is claimed is:

1. A pallet for storage and transport of goods, comprising;

an upper deck that serves as a standing surface for the goods;

standing feet assembled onto an underside of the upper deck at edges of the upper deck, said edges comprising first and second longitudinal side edges and first and second short side edges; and first, second, third, fourth and fifth accommodation channels formed into the upper deck; and at least two reinforcement strips secured via the standing feet in at least two of the accommodation channels respectively;

wherein each of the at least two reinforcement strips has the same length and ends slanting at an acute angle;

wherein the upper deck is divided into at least first and second rectangular partial regions, the first partial region having said first accommodation channel disposed diagonally in the first partial region, and the second partial region having said second accommodation channel disposed diagonally in the second partial region;

wherein the third accommodation channel is disposed along a border between the first and second partial region;

wherein the fourth and fifth accommodation channels are respectively disposed along the first and second longitudinal side edges of the upper deck; and wherein the partial regions are configured so that all of the accommodation channels run from one of the standing feet disposed at one of the edges of the pallet to one of the standing feet disposed at an opposite one of the edges.

2. The pallet according to claim 1, further comprising recesses formed into standing surfaces of the standing feet, in which the feet can be attached to runners for connecting one another.

3. The pallet according to claim 2, wherein the recesses in the standing surfaces of the standing feet are disposed in a symmetrical pattern.

4. The pallet according to claim 1, wherein the at least two reinforcement strips in the accommodation channels are rectangular in cross-section.

5. The pallet according to claim 4, wherein the at least two reinforcement strips are tubes.

6. The pallet according to claim 4, wherein the at least two reinforcement strips are made of metal.

7. The pallet according to claim 1, further comprising additional accommodation channels along the short side edges of the upper deck.

8. The pallet according to claim 1, wherein the upper deck is an injection-molded plastic part.

9. The pallet according to claim 1, wherein the standing feet are injection-molded plastic parts.

10. The pallet according to claim 1, further comprising lateral connection elements for an additional upper deck.

* * * * *